US005997342A

United States Patent [19]

Suzuki

[11] Patent Number: 5,997,342

[45] Date of Patent: Dec. 7, 1999

[54] CONNECTOR-COUPLING DETECTING STRUCTURE

[75] Inventor: Shogo Suzuki, Shizuoka, Japan

[73] Assignee: Yazaki Corporation, Tokyo, Japan

[21] Appl. No.: 09/017,808

[22] Filed: Feb. 3, 1998

[30] Foreign Application Priority Data

Feb. 4, 1997 [JP] Japan ..... 9-021260

[51] Int. Cl.[6] ..... H01R 4/24

[52] U.S. Cl. ..... 439/489; 439/372

[58] Field of Search ..... 439/488–9, 347, 439/345, 346, 355, 357, 359, 372, 367, 371, 519, 521, 523, 684, 685, 686, 687, 696, 467, 464–5, 906, 586–9, 595–8, 603, 752; 174/138 F, 155, 188, 190

[56] References Cited

U.S. PATENT DOCUMENTS

| | | | |
|---|---|---|---|
| 4,341,428 | 7/1982 | Hatch et al. | 339/91 R |
| 4,441,776 | 4/1984 | Anhalt | 339/91 R |
| 5,306,195 | 4/1994 | Hayashi | 439/587 |

FOREIGN PATENT DOCUMENTS 5-57776 7/1993 Japan .

*Primary Examiner*—Lincoln Donovan

*Attorney, Agent, or Firm*—Armstrong, Westerman, Hattori, McLeland & Naughton

[57] ABSTRACT

A connector-coupling detecting structure which can surely detect and prevent incomplete coupling of connectors by means of opening and closing operation of their covers. A couple of covers with a freely opening and closing mechanism are provided on one connector and abutting portions relative to an end portion of the other connector are provided at base portions of the covers, wherein the covers are pushed by respective spring members in their opening directions. The abutting portions push the other connector, being in a state of incomplete coupling, with pressure due to the spring members in a connector-uncoupling direction. Pushing inclined-walls relative to a rear step portion of the other connector are formed on the covers. A provisional engaging means is provided between the connectors and a final engaging means is provided between the covers. Thus, the connector-coupling detecting structure which can surely detect and prevent the incomplete coupling of the connectors by means of opening and closing operation of their covers can be realized.

8 Claims, 5 Drawing Sheets

CONNECTOR-COUPLING DETECTING STRUCTURE

BACKGROUND OF THE INVENTION

1. Field of the Invention

The present invention relates to a connector-coupling detecting structure wherein incomplete coupling of connectors can be surely detected and prevented by means of opening and closing operation of their covers.

2. Description of the Prior Art

FIGS. 6 and 7 show a prior art connector-coupling detecting structure disclosed in Japanese Utility Model Registration Application Laid-open No. 5-57776.

In this structure, a male connector 45 with a hood 44 is completely coupled to a female connector 43 on equipment 42 side by means of a cylindrical cover 41.

A cam-like inclined guide 46 and a locking portion 47 following the inclined guide 46 are formed at a base portion of the female connector 43, and an engaging projection 48 relative to the inclined guide 46 is formed inside a front end portion of the cover. And, an abutting wall 50 relative to a rear end portion 49 of the male connector 45 is formed inside the cover 41. The cover 41 is installed outside the male connector 45.

The engaging projection 48 of the cover 41 slides along the inclined guide 46 of the female connector 43 by provisionally coupling the male connector 45 to the female connector 43 and by rotating the cover 41 clockwise, while the abutting wall 50 of the cover 41 pushes the male connector 45 in a connector-coupling direction and then, as shown in FIG. 7, complete coupling of both the connectors 43,45 is achieved and the engaging projection 48 engages the locking portion 47.

In the aforementioned prior art structure, however, it has been difficult to visually check the locking of the cover 41, that is, it has been difficult to detect completion of fitting of the cover 41 and complete coupling of the connectors 43,45, in case that the locking portion 47 is located in a narrow place near equipment.

SUMMARY OF THE INVENTION

An object of the present invention is to provide a connector-coupling detecting structure which can easily and surely detect a state of coupling of connectors.

In order to achieve the above object, the present invention adopts a couple of covers, with a freely opening and closing mechanism, provided on one connector, and abutting portions relative to an end portion of the other connector (a mating connector) are provided at base portions of the covers, wherein the covers are pushed by respective spring members in their opening directions and the abutting portions push the other connector, being in a state of incomplete coupling, with pressure due to the spring members in a connector-uncoupling direction. It is effective that pushing inclined-walls relative to a rear step portion of the other connector are formed on the covers. Further, a provisional engaging means is provided between the connectors and a final engaging means is provided between the couple of covers.

According to the present invention as described above, since the abutting portions of the covers push the other connector with pressure due to the spring members in the connector-uncoupling direction when the connectors are in a state of the incomplete coupling, the other connector is pushed out and the covers become wide open, whereby a worker can visually detects incomplete coupling of the connectors easily and surely. And, on uncoupling the connectors, the respective abutting walls of the covers push the other connector with pressure due to the spring members in the uncoupling direction, whereby connector-uncoupling work can be performed easily with weak force. Further, on closing the covers, the inclined-walls of the covers push the rear step portion of the other connector in a connector-coupling direction and then the connectors are surely coupled, whereby incomplete coupling of the connectors can be prevented. Still further, closing operation of the covers can be surely performed with both hands by provisionally coupling the connectors with the provisional engaging means, and furthermore the other connector can be held without being drawn out by closing up the covers with the final engaging means, which can eliminate another final engaging means between the connectors.

The above and other objects and features of the present invention will be more apparent from the following description taken in conjunction with the accompanying drawings.

DETAILED DESCRIPTION OF THE PREFERRED EMBODIMENTS

Figure 1:
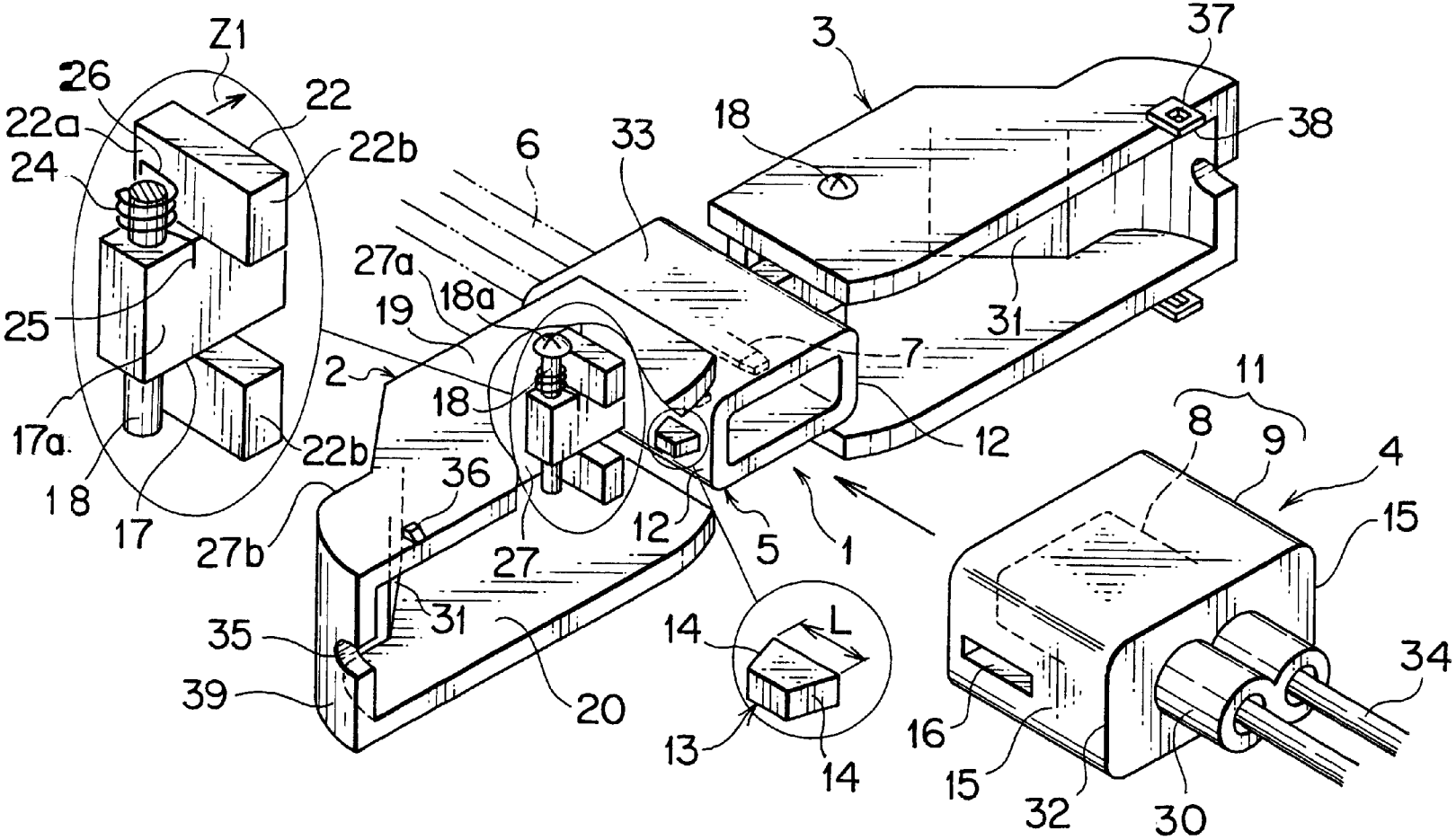
FIG. 1 is an exploded perspective view showing an embodiment of a connector-coupling detecting structure in accordance with the present invention.

FIG. 1 shows an embodiment of a connector-coupling detecting structure according to the present invention.

In this structure, a female connector 1 is provided with a couple of divided covers 2,3 rotatable on both sides, and a male connector 4 is coupled to the female connector 1 by means of the couple of covers 2,3 while being covered with them, wherein a final coupling of the connectors 1,4 can be detected with a closing-up of the covers 2,3.

The female connector 1 may be projected integrally with equipment (not shown) or be of a separate one like the male connector 4.

The female connector 1 consists of a female connector housing 5 made of synthetic resin and male terminals 7 connected to electric wires 6. The male connector 4 is consists of an inner housing 8 made of synthetic resin, a hood portion 9 formed integrally with the inner housing 8 on the outside, and female terminals 10 (FIG. 3) accommodated in the inner housing 8. The inner housing 8 and the hood portion 9 constitute a male connector housing 11.

Provisional engaging projections 13 are formed near the front end of both side walls 12 of the above female connector housing 5 and slotted engaging holes 16 relative to the provisional engaging projections 13 are formed on both side walls 15 of the hood portion 9 of the male connector 4. The provisional engaging projections 13 each have front and rear tapered guide planes 14. The engaging holes 16 are notched longer than length L of the provisional engaging projections 13, and the provisional engaging projections 13 can slide in the engaging holes 16 in a connector-coupling-and-uncoupling direction (longitudinal direction). The provisional engaging projections 13 and the engaging holes 16 make up a provisional engaging means.

Figure 2:
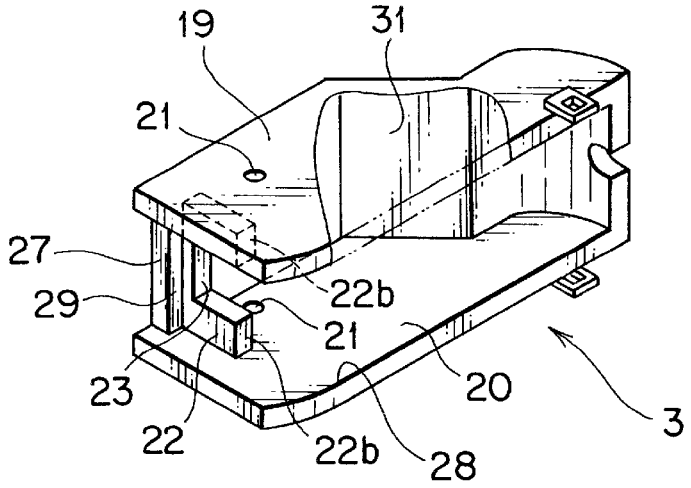
FIG. 2 is a perspective view showing a cover of FIG. 1.

Bearing-wall 17 projects at an intermediate portion of each side wall 12 of the female connector housing 5. Each bearing-wall 17 is vertically located inside the covers 2,3. Each bearing-wall 17 has a metallic hinge pin 18 penetrating the bearing-wall 17 vertically. The covers 2,3 each are supported rotatably by the respective hinge pins 18. That is, the hinge pins 18 each penetrate both upper and lower walls 19,20 of the covers 2,3 at their base-end portion sides (rear-end sides) and pin-head portions 18*a* each are put into contact with the respective upper walls 19. As shown in FIG. 2, penetration holes 21 for the hinge pins 18 are formed on both the upper and lower walls 19,20 of the covers 2,3.

Abutting walls (abutting portions) 22, in a substantially lateral-凵 shape, each are formed vertically in the respective covers 2,3, and the above bearing-walls 17 each are orthogonally inserted into respective 凵 -portions 23 in the middle of the abutting walls 22. The abutting walls 22 are located inner side, i.e. female connector 1 side, than the hinge pins 18.

A torsion coil spring 24 (FIG. 1) is attached to each of the hinge pin 18, and a hooking portion 25 at the lower end of the torsion coil spring 24 engages a front-side surface 17*a* of the bearing-wall 17 and another hooking portion 26 at the upper end of the torsion coil spring 24 engages an outer-side surface 22*a* of the abutting wall 22. The torsion coil springs 24 each are pushing the respective abutting walls 22 like an arrow Z1, whereby the covers 2,3 are being pushed in their opening directions.

As shown in FIG. 2, the abutting wall 22 is arranged perpendicular to both a side wall 27 and the upper and lower walls 19,20 of the covers 2,3. Abutting surfaces 22*b* relative to the male connector 4 are formed at a cover-opening 28 (FIG. 2) end side of each abutting wall 22. The abutting surfaces 22*b* each are located above and below the 凵 -portion 23, respectively.

Tapered pushing inclined-wall 31 relative to the male connector 4 is formed at an inner intermediate portion of each of the side walls 27 of the covers 2,3. As shown in FIG. 1, the pushing inclined-walls 31 each incline inwardly toward the female connector 1. Base-end portion 27*a* side (rear half) of the respective covers 2,3 is wide and narrow width portion 27*b* side (front half) of the respective covers 2,3 is narrow, bordered by the respective pushing inclined-walls 31. The pushing inclined-walls 31 are capable of getting in contact with a rear step portion 32 (FIG. 4) of the male connector 4.

In this embodiment, both sides of the female connector 1 slightly enter respective openings 29 (FIG. 2) at the base-end of the covers 2,3 as shown in FIG. 1, and upper and lower walls 33 of the female connector housing 5 are located in contact with the respective upper and lower walls 19,20 of the covers 2,3. Opening 35 for drawing out electric wires 34 connected to the male connector 4 are formed on each end wall 39 of the covers 2,3.

Final engaging projections 36 each are formed on the upper and lower walls 19,20 of the cover 2, and resilient engaging frame-pieces 38 each having an engaging hole 37 relative to the final engaging projection 36 are projectingly formed on the upper and lower walls 19,20 of the other cover 3, respectively. The final engaging projection 36 and the engaging frame-piece 38 make up a final engaging means.

Figure 3:
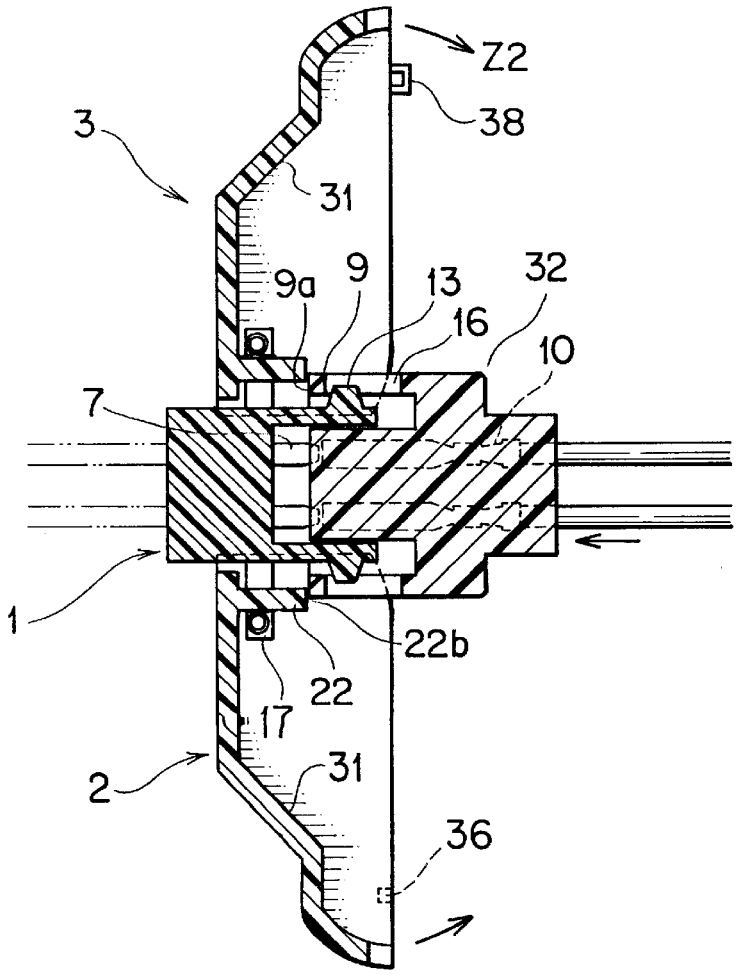
FIG. 3 is a longitudinal sectional view showing a state of provisional coupling of connectors.

FIG. 3 shows a state of a provisional coupling of the male connector 4 to the female connector 1. Front end 9*a* of the hood portion 9 of the male connector 4 has climbed over the provisional engaging projections 13 of the female connector 1, and the provisional engaging projections 13 are engaging the respective engaging holes 16 movably in a longitudinal direction. The terminals 7,10 are going to be connected each other. The front end 9*a* of the hood portion 9 abuts against the abutting surfaces 22*b* of the covers 2,3 and pushes the covers 2,3 in each closing direction like an arrow Z2 against pressure by the torsion coil springs 24 (FIG. 1).

In case that coupling operation of the male connector 4 to the female connector 1 is stopped on the way from a state of FIG. 3, that is, in case of incomplete coupling, the front end 9*a* of the hood portion 9 is pushed by the abutting surfaces 22*b* of the abutting walls 22 in the connector-uncoupling direction since the covers 2,3 are pushed by the respective torsion coil springs 24 in each opening direction, whereby the male connector 4 is pushed out and the covers 2,3 are put at a wide open state.

Figure 4:
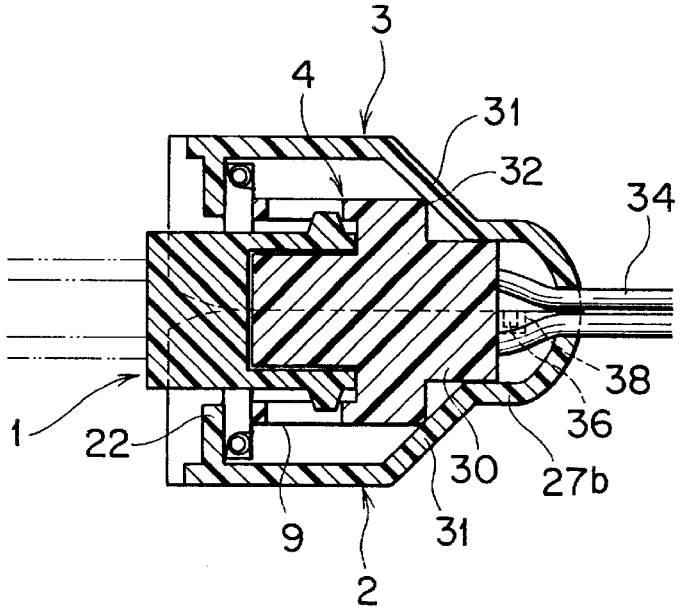
FIG. 4 is a longitudinal sectional view showing a state of final coupling of the connectors.

The coupling operation of the male connector 4 is performed by closing the covers 2,3 from the state of FIG. 3. That is, the pushing inclined-walls 31 of the covers 2,3 push the rear step portion 32 of the male connector 4 in the connector-coupling direction to thereby couple the male connector 4 to the female connector 1 as shown in FIG. 4. The abutting walls 22 of the covers 2,3 are pushed by the hood portion 9 of the male connector 4 and rotate in each closing direction integrally with the respective covers 2,3, and then the abutting against the hood portion 9 is released.

Upon complete coupling of the connectors 1,4, the final engaging projections 36 on the cover 2 engage the engaging frame-pieces 38 on the cover 3 and then both the covers 2,3 are locked each other. The pushing inclined-walls 31 of the covers 2,3 abut the rear step portion 32 of the male connector 4, and the narrow width portions 27*b* at the front half of the covers 2,3 nip an electric wire drawing-out portion 30, in a cylindrical shape, of the male connector 4. The covers 2,3 wholly cover and protect the male connector 4 and make the male connector 4 engaged or held steady in both longitudinal and transverse directions. The electric wires 34 of the male connector 4 are drawn out from the openings 35 on the covers 2,3.

Figure 5:
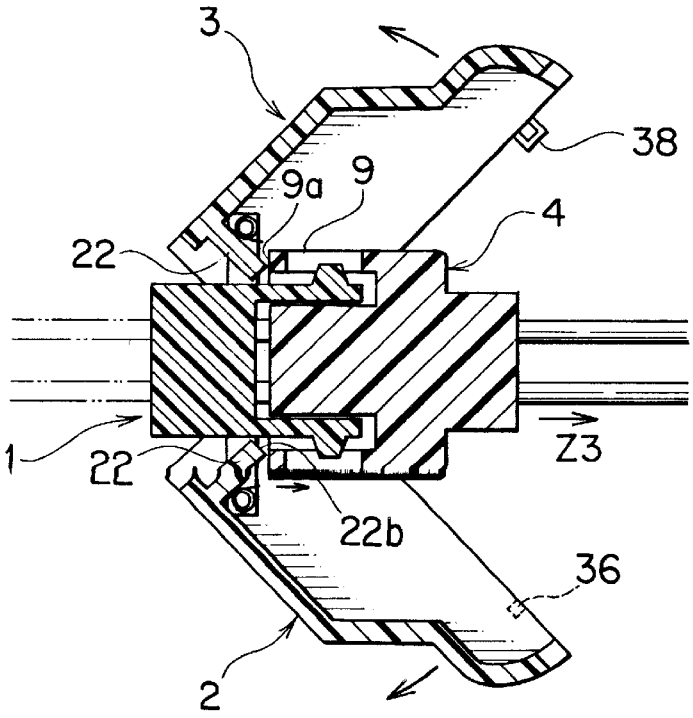
FIG. 5 is a longitudinal sectional view showing a state of uncoupling the connectors.
Figure 6:
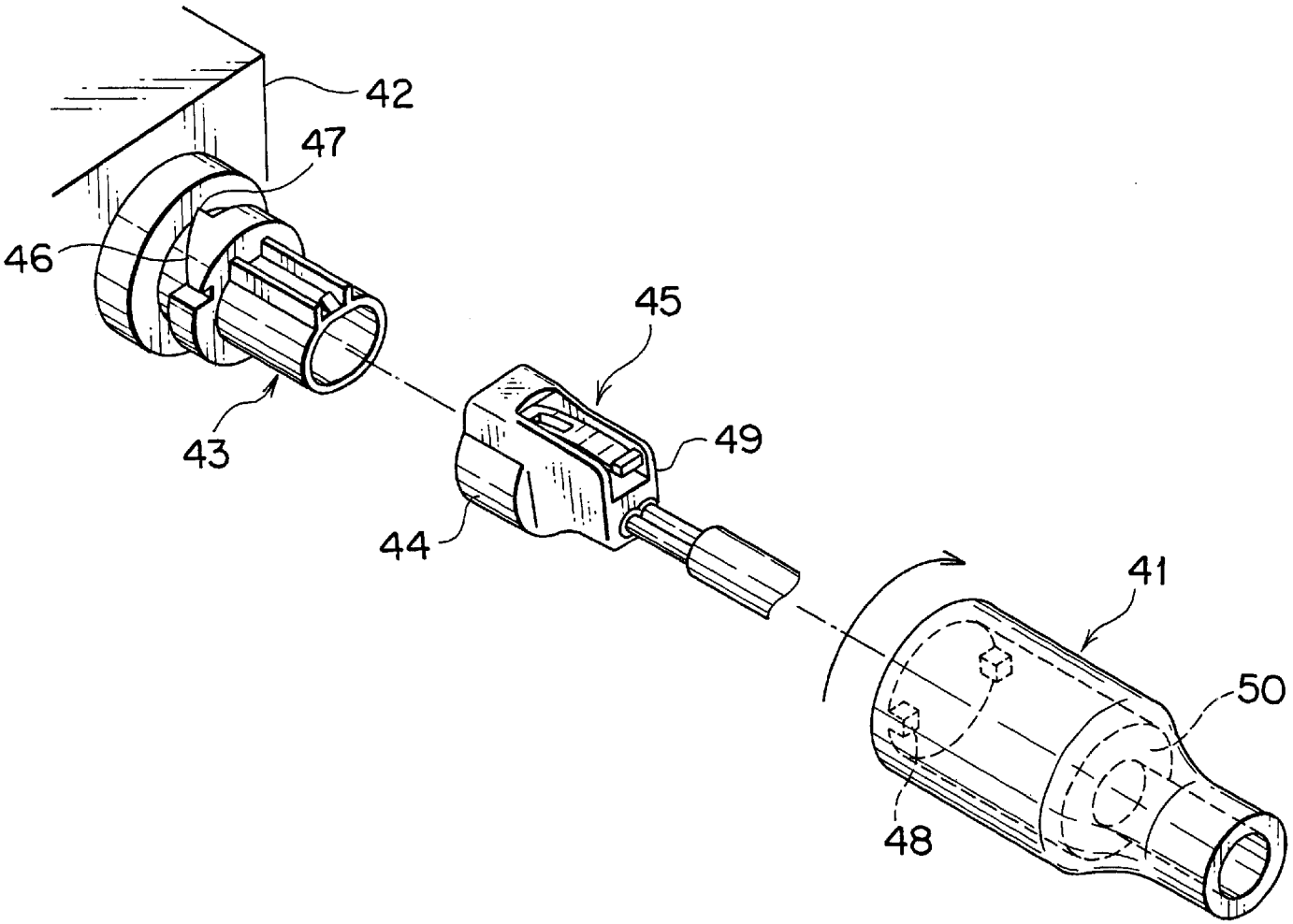
FIG. 6 PRIOR ART
FIG. 6 is an exploded perspective view showing a prior art.
Figure 7:
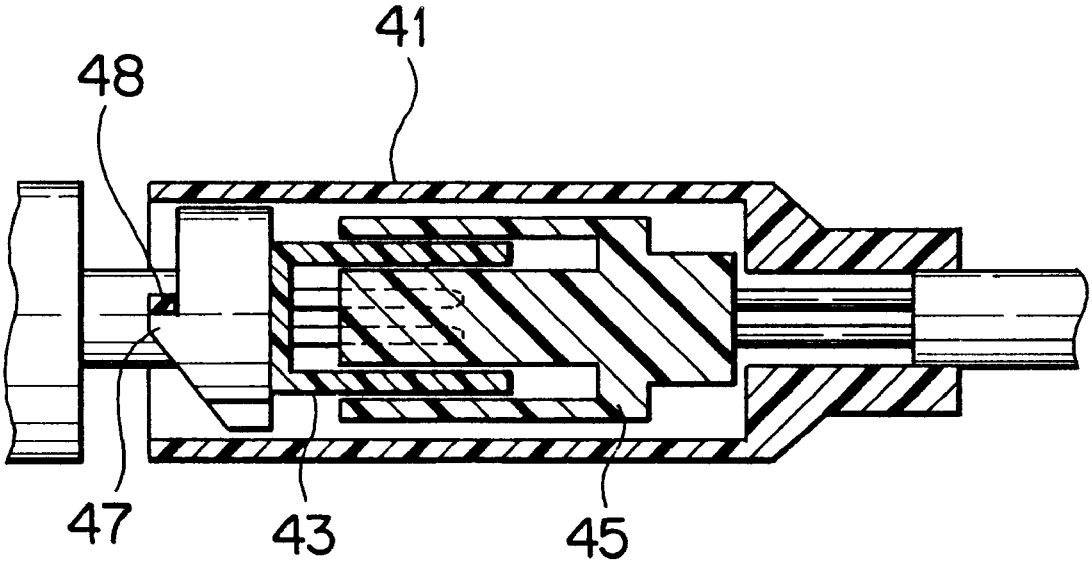
FIG. 7 PRIOR ART
FIG. 7 is a longitudinal sectional view showing a state of coupling of the connectors of FIG. 6.

When the male connector 4 is to be uncoupled, the lock by means of the final engaging means 36,38 between the covers 2,3 is released and the covers 2,3 are opened as shown in FIG. 5, whereby the abutting surfaces 22*b* of the covers 2,3 push the front end 9*a* of the hood portion 9 in the connector-uncoupling direction like an arrow Z3 with the aid of pressure working in the opening directions of the covers 2,3 by means of the torsion coil springs 24.

What is claimed is:

1. A connector-coupling detecting structure comprising:

a first connector and a second connector;

a couple of covers provided on said first connector, said covers being able to move freely between an opened position and a closed position;

abutting portions provided at base portions of said covers of said first connector; and spring members applying a pushing force on said covers of said first connector toward the opened position of said covers.

wherein said abutting portions of said covers of said first connector are arranged to push an end portion of said second connector in a connector-uncoupling direction thereof when said covers are pushed by said spring members toward the opened position.

2. A connector-coupling detecting structure comprising:

a first connector and a second connector;

a couple of covers provided on said first connector, said covers being able to move freely between an opened position and a closed position;

abutting portions provided at base portions of said covers of said first connector;

spring members applying a pushing force on said covers of said first connector toward the opened position of said covers; and pushing walls formed on said covers of said fist connector, said pushing walls being inclined relative to a rear step portion of said second connector, wherein said abutting portions of said covers of said first connector are arranged to push an end portion of said second connector in a connector-uncoupling direction thereof when said covers are pushed by said spring members toward the opened position, and said pushing walls of said covers of said first connector are arranged to push said rear step portion of said second connector in a connector-coupling direction when said covers of said first connector are pushed toward the closed position.

3. The connector-coupling detecting structure according to claim 1, wherein a provisional engaging means is provided between said connectors and a final engaging means is provided between said covers.

4. The connector-coupling detecting structure according to claim 2, wherein a provisional engaging means is provided between said connectors and a final engaging means is provided between said covers.

5. The connector-coupling detecting structure according to claim 4, further comprising an electric wire drawing-out portion on said second connector and narrow width portions on said covers, said narrow width portions being relative to said electric wire drawing-out portion, wherein said second connector is held steady in both longitudinal and transverse directions by said narrow width portions and said pushing walls both on said covers, in a state of final engagement thereof.

6. The connector-coupling detecting structure according to claim 4, wherein said final engaging means of said covers susbtitutes for a final engaging means of said connectors.

7. The connector-coupling detecting structure according to claim 5, wherein said final engaging means of said covers substitutes for a final engaging means of said connectors.

8. The connector-coupling detecting structure according to any one of claims 3–7, wherein said provisional engaging means consists of provisional engaging projections formed on said first connector and engaging holes formed on said second connector, said provisional engaging projections being allowed to slide in said engaging holes in a longitudinal direction according to movement of said second connector pushed by said abutting portions.

* * * * *